US010224624B2

(12) United States Patent
Nair et al.

(10) Patent No.: US 10,224,624 B2
(45) Date of Patent: Mar. 5, 2019

(54) ANTENNA ARRAY ASSEMBLY

(71) Applicant: Cambium Networks Limited, Ashburton, Devon (GB)

(72) Inventors: Deepu Nair, Kerala (IN); Nigel King, Ashburton (GB); Neeraj Kumar Maurya, Uttar Pradesh (IN)

(73) Assignee: CAMBIUM NETWORKS LIMITED, Ashburton Devon (GB)

( * ) Notice: Subject to any disclaimer, the term of this patent is extended or adjusted under 35 U.S.C. 154(b) by 133 days.

(21) Appl. No.: 15/192,171

(22) Filed: Jun. 24, 2016

(65) Prior Publication Data

US 2017/0271758 A1 Sep. 21, 2017

(30) Foreign Application Priority Data

Mar. 17, 2016 (IN) ..... 201641009265
Jun. 22, 2016 (GB) ..... 1610898.7

(51) Int. Cl.

| | |
|---|---|
| ***H01Q 1/48*** | (2006.01) |
| ***H01Q 19/02*** | (2006.01) |
| ***H01Q 21/00*** | (2006.01) |
| ***H01Q 1/42*** | (2006.01) |
| ***H01Q 1/52*** | (2006.01) |
| ***H01Q 15/14*** | (2006.01) |
| ***H01Q 19/10*** | (2006.01) |
| ***H01Q 21/08*** | (2006.01) |
| *H01Q 1/24* | (2006.01) |

(52) U.S. Cl.

CPC ..... *H01Q 1/48* (2013.01); *H01Q 1/42* (2013.01); *H01Q 1/52* (2013.01); *H01Q 15/14* (2013.01); *H01Q 19/021* (2013.01); *H01Q 19/106* (2013.01); *H01Q 21/0031* (2013.01); *H01Q 21/08* (2013.01); *H01Q 1/246* (2013.01)

(58) Field of Classification Search

CPC H01Q 1/42; H01Q 1/52; H01Q 15/14; H01Q 19/021; H01Q 21/0031; H01Q 21/08

See application file for complete search history.

(56) References Cited

U.S. PATENT DOCUMENTS

2003/0184479 A1 10/2003 Collins
2007/0146225 A1* 6/2007 Boss ..... H01Q 21/08 343/797

(Continued)

FOREIGN PATENT DOCUMENTS

WO 98/36472 8/1998
WO 2015/014834 A1 2/2015

*Primary Examiner* — Dieu Hien T Duong

(74) *Attorney, Agent, or Firm* — Brinks Gilson & Lione

(57) ABSTRACT

An antenna array assembly comprises a ground plate, an array of radiator elements disposed in a spaced relationship with a first face of the ground plate between first and second substantially parallel conductive walls projecting from the first face of the ground plate, and a first and second conductive plate. Each of the first and second conductive plates is electrically isolated from the ground plate, and each is disposed in an upstanding relationship to the first face of the ground plate in a substantially parallel relationship with the first and second conductive walls. This provides reduced radiation in at least one direction in the hemisphere on the opposite side of the ground plate to the first face.

18 Claims, 7 Drawing Sheets

(56) References Cited

U.S. PATENT DOCUMENTS

| | | | | |
|---|---|---|---|---|
| 2009/0096700 | A1* | 4/2009 | Chair | H01Q 1/246 343/797 |
| 2010/0013729 | A1* | 1/2010 | Harel | H01Q 1/246 343/837 |
| 2010/0127939 | A1 | 5/2010 | Yusa | |
| 2016/0056539 | A1 | 2/2016 | Fujita et al. | |
| 2016/0172765 | A1* | 6/2016 | Motta-Cruz | H01Q 1/1271 343/834 |

* cited by examiner

ANTENNA ARRAY ASSEMBLY

RELATED APPLICATIONS

This application claims the benefit of and priority to British Patent Application No. GB 1610898.7, filed Jun. 22, 2016, and claims the benefit of and priority to Indian Patent Application No. 201641009265, filed Mar. 17, 2016, the entire contents of each of which are incorporated herein by reference.

TECHNICAL FIELD

The present invention relates generally to an antenna array, and more specifically, but not exclusively, to an antenna array assembly having improved front-to-back isolation.

BACKGROUND

In modern wireless systems, such as, for example, cellular wireless access and fixed wireless access networks, there is a need for equipment, such as radio transceiver equipment in user equipment or at base stations or access points, which is economical to produce, while having high performance at radio frequencies. Increasingly high radio frequencies are being used as spectrum becomes scarce and demand for bandwidth increases. Furthermore, antenna systems are becoming increasingly sophisticated, often employing arrays of antenna elements to provide controlled beam shapes and/or MIMO (multiple input multiple output) transmission.

It is known to implement a radio transceiver having an array of antenna radiator elements, which may be formed as copper areas printed on a dielectric. A feed network may connect the antenna elements to transmit and receive chains of the transceiver. A ground plate may be provided, which may underlie the array of radiator elements, and which provides a radio frequency ground for the radiator elements.

In a cellular wireless networks, it is typically beneficial for an antenna array which is intended to transmit and/or receive radiation to and/or from a cell, for example to an angular sector, to be configured to minimise radiation into, and reception from, other cells. It may, in particular, be beneficial to provide a high so-called front-to-back ratio for the antenna, that is to say a high attenuation of radiation and/or reception in directions opposite to the direction of the main beam, in comparison with the gain of the main beam, since this radiation and/or reception may appear as interference to other cells. A high front-to-back ratio may improve the capacity of the system by reducing interference. However, conventional antenna array assemblies may achieve a limited front-to-back ratio.

It is an object of the invention to mitigate the problems of the prior art.

SUMMARY

In accordance with a first aspect of the present invention, there provided an antenna array assembly, comprising:

a ground plate;

an array of radiator elements disposed in a spaced relationship with a first face of the ground plate between first and second substantially parallel conductive walls projecting from the first face of the ground plate; and a first and second conductive plate, each being electrically isolated from the ground plate, and each being disposed in an upstanding relationship to the first face of the ground plate in a substantially parallel relationship with the first and second conductive walls, whereby to provide reduced radiation in at least one direction in the hemisphere on the opposite side of the ground plate to the first face.

This may provide an antenna assembly with an improved front-to-back ratio, which may provide reduced interference and higher capacity in cellular wireless networks.

In an embodiment of the invention, the first and second conductive plates are disposed outside the first and second conductive walls with respect to the array of radiator elements.

In an embodiment of the invention, the first and second conductive plates are elongate, having a long side parallel to the ground plate, and having a width between 0.2 and 0.4 wavelengths at an operating frequency of the antenna array assembly. This may provide a good front-to-back ratio. A width of substantially a quarter of a wavelength may be particularly beneficial.

In an embodiment of the invention, the first and second conductive plates are each located between 0.1 and 0.4 wavelengths from the respective conductive wall at an operating frequency of the antenna array assembly. This provides a good front-to-back ratio. Locating each of the first and second conductive plates substantially a quarter of a wavelength from the respective conductive wall of the first and second conductive walls may be particularly beneficial.

In an embodiment of the invention, the first and second conductive plates are each supported by a non-conductive support member attached to the ground plate.

This allows the conductive plates to be held in place while maintaining electrical isolation.

In an embodiment of the invention, the first and second conductive plates are disposed at least 0.1 wavelengths away from the ground plate at an operating frequency of the antenna array assembly.

This may improve the contribution of the conductive plates to front-to-back isolation.

In an embodiment of the invention, the first and second conductive walls project from the ground plate by at least a quarter of a wavelength at an operating frequency of the antenna array assembly.

This may allow the conductive walls to contribute to front-to-back isolation.

In an embodiment of the invention, the antenna array assembly comprises third and fourth conductive walls projecting from the first face, in a substantially parallel relationship with the first and second conductive walls, and further from the array of radiator elements than are the first and second conductive plates.

This may further improve front-to-back isolation.

In an embodiment of the invention, the antenna array assembly comprises a plurality of further conductive walls projecting from the first face, in a substantially parallel relationship with the first and second conductive walls, and further from the array of radiator elements than are the third and fourth conductive walls.

This may improve front-to-back isolation still further.

In an embodiment of the invention, each conductive wall has a first substantially vertical section extending from the ground plate and a second section connected to the first section which is inclined towards the array of radiator elements.

This may further improve front-to-back isolation.

In an embodiment of the invention, the radiator elements are patch radiator elements configured to radiate and/or receive with at least a first polarisation normal to a long axis of the first and second conductive plates.

This may provide improved front-to-back isolation in particular for the first polarisation.

In an embodiment of the invention, the radiator elements are configured as a linear array having a longitudinal axis parallel to a long axis of the first and second conductive plates.

This configuration may be particularly suited for providing improved front-to-back isolation for the linear array.

In an embodiment of the invention, the ground plate and the conductive walls comprise a non-conductive material having a conductive coating.

This allows the ground plate to be light weight and to be moulded in a shape to include the conductive walls, which may be an economical manufacturing method. The non-conductive moulding may comprises a plastic material and the conductive surface may comprise copper.

In accordance with a second aspect of the invention there is provided a method of providing increased front-to-back isolation in an antenna array assembly having a ground plate and an array of radiator elements disposed in a spaced relationship with a first face of the ground plate, comprising:

providing first and second substantially parallel conductive walls projecting from the first face, the first being on one side of the array of radiator elements and the second being on the opposite side; and providing a first and second conductive plate, each being electrically isolated from the ground plate, and each being disposed in an upstanding relationship to the first face of the ground plate in a substantially parallel relationship with the first and second conductive walls.

Further features and advantages of the invention will be apparent from the following description of preferred embodiments of the invention, which are given by way of example only.

DETAILED DESCRIPTION

By way of example, embodiments of the invention will now be described in the context of an antenna array assembly having a ground plate which is a backing plate for an array of printed antenna elements for use as a sector antenna for an access point of a fixed wireless access system. However, it will be understood that this is by way of example only and that other embodiments may be antenna array assemblies in other wireless systems. In an embodiment of the invention, an operating frequency of approximately 5 GHz is used, but the embodiments of the invention are not restricted to this frequency, and in particular embodiments of the invention are suitable for use at lower or higher operating frequencies of up to 60 GHz or even higher.

Figure 1:
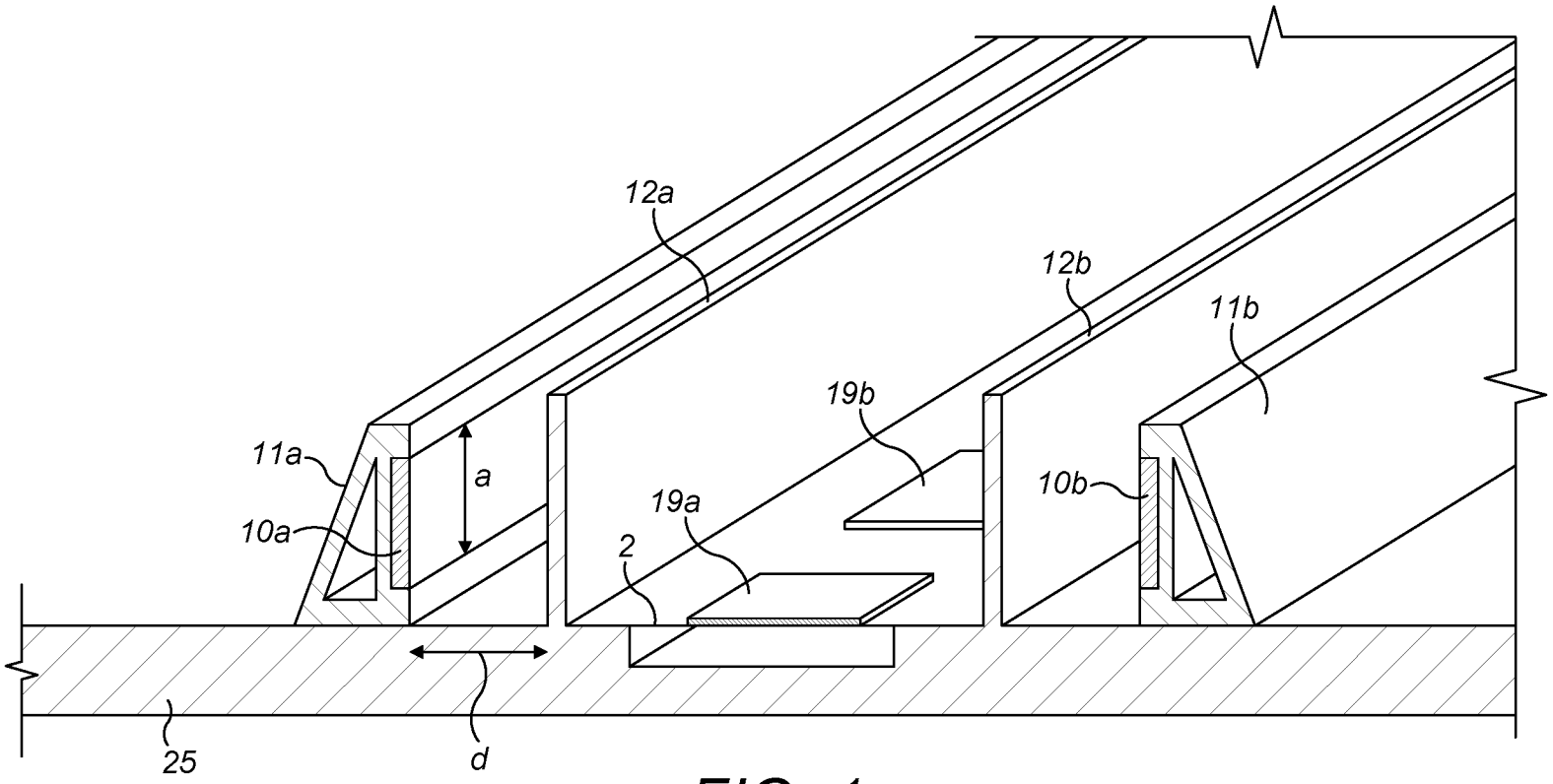
FIG. 1 is a schematic diagram of an antenna array assembly in an embodiment of the invention.

FIG. 1 is a schematic diagram of an antenna array assembly in an embodiment of the invention. The antenna array assembly comprises a ground plate 25, and an array of radiator elements 19*a*, 19*b* between first and second substantially parallel conductive walls 12*a*, 12*b* projecting from the ground plate 25. A first and second conductive plate 10*a*, 10*b* is provided, each being electrically isolated from the ground plate 25, in a substantially parallel relationship with the first and second conductive walls 12*a*, 12*b*. This may provide reduced radiation in at least one direction in the hemisphere on the opposite side of the ground plate to the radiator elements. As shown in FIG. 1, the conductive plates 10*a*, 10*b* may be supported and isolated from the ground plate 25 by non-conductive brackets 11*a*, 11*b*, typically made of plastic. The radiator elements 19*a*, 19*b* may be formed from a metallic layer supported by a non-conductive film 2, such as polyester, in a spaced relationship to the ground plate 25, which may have recessed portions under the radiator elements.

Figure 2:
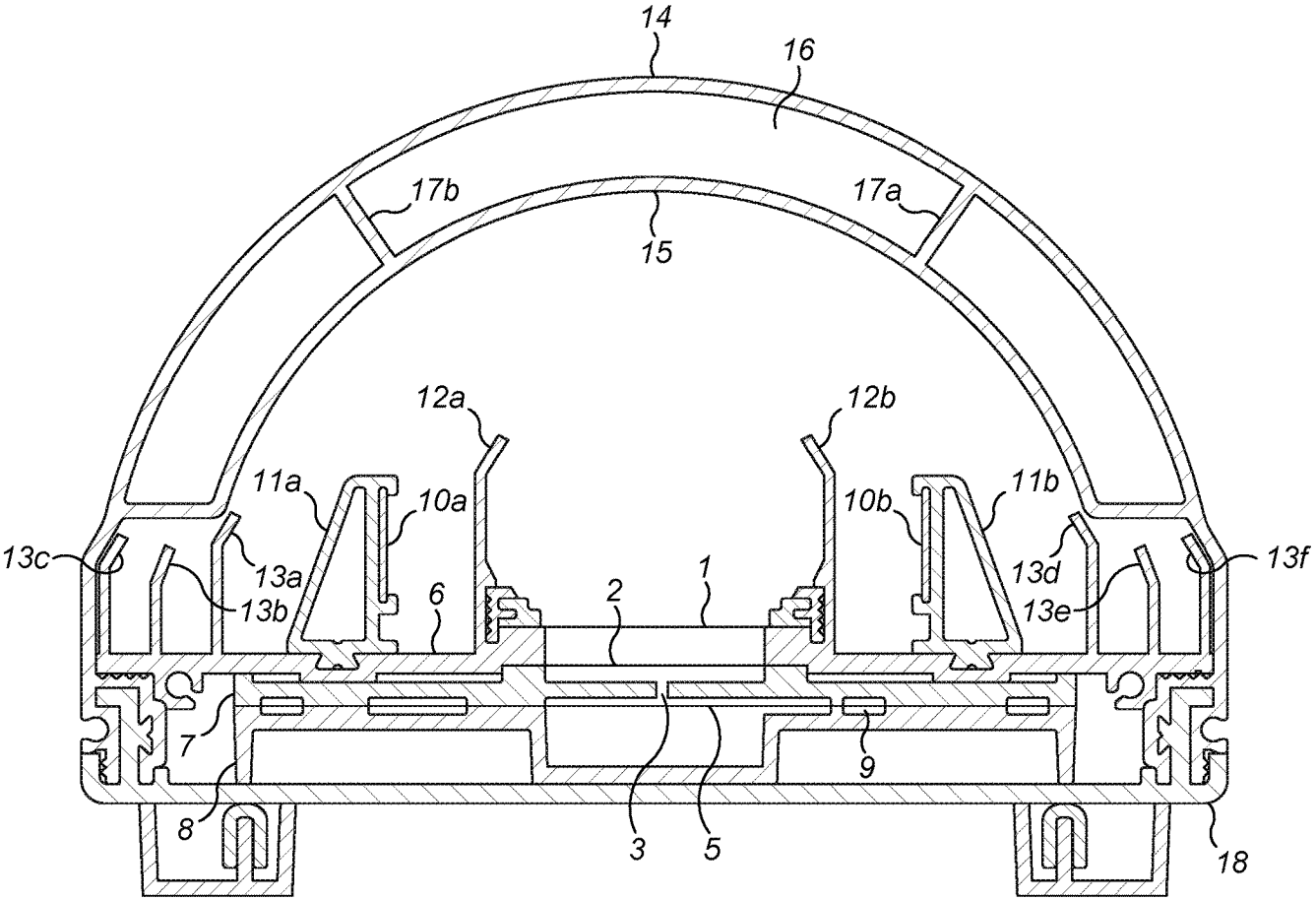
FIG. 2 is a cross-sectional view of an antenna array assembly in an embodiment of the invention.
Figure 3:
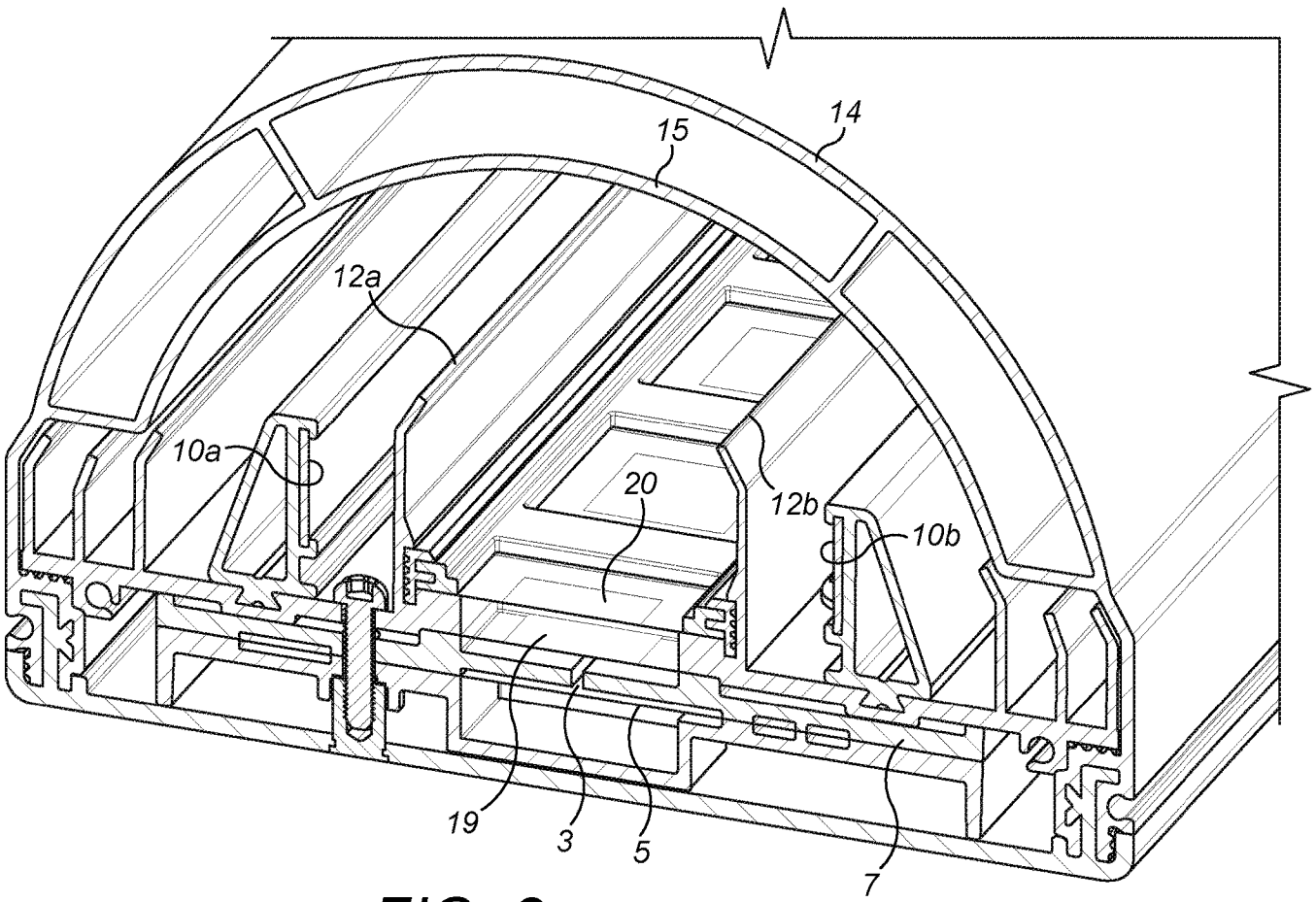
FIG. 3 is an oblique view of an antenna array assembly in an embodiment of the invention.

FIGS. 2 and 3 show a cross-sectional and oblique view respectively of an antenna array assembly in an embodiment of the invention, having corresponding features to those shown in the schematic representation of FIG. 1. The antenna array assembly comprises an array of radiator elements, in this example a linear array of patch radiator elements, one of which 19 is shown in the oblique view of FIG. 3, each of which is a rectangular conductive patch supported on a non-conductive film 2. Each patch is fed at radio frequency with a signal passing through an aperture 3 from a feed track printed on a non-conductive film 5 crossing below the aperture. The array of radiator elements is typically fed with signals at appropriate amplitudes and phases to form a radiation beam, by a feed network which connects each feed track to a radio transceiver. In the example shown in FIGS. 2 and 3, each patch radiator element 19 is provided with a parasitic director element 20, supported on a non-conductive film 1, which may improve the broadband radiation performance of the patch radiator element. Other arrangements of radiator elements are possible, in addition to aperture coupled radiator elements; for example in other embodiments the radiator elements may be edge-fed patch radiator elements, or other well-known types of radiator element.

The antenna array assembly in the example shown by FIGS. 2 and 3 is provided with a ground plate corresponding to the ground plate 25 of FIG. 1, which is a conductive, typically metallic, structure. In the example of the embodiment of FIG. 2 and FIG. 3 the ground plate comprises two parts, an outer ground plate 6 and an inner ground plate 7, together forming the ground plate. A cover plate 8 is also provided. The two parts of the ground plate 6,7 and the cover plate 8 are connected together electrically, by contact and/or by metallic fixings, to form a single grounded structure, providing a radio frequency ground for the feed tracks and the radiator elements.

FIGS. 2 and 3 also show that antenna array assembly may be enclosed in a non-conductive, typically plastic enclosure. The assembly has a non-conductive bottom cover 18, and a non-conductive radome 14, 15, 17*a*, 17*b*. The radiated beam from the array of radiator elements is typically radiated away from the grounded structure 6, 7, 8 and is radiated through the radome. The non-conductive enclosure provides environmental protection for the antenna array assembly.

As may be seen from FIGS. 1, 2 and 3, the antenna array assembly has an array of radiator elements 19; 19*a*, 19*b* disposed in a spaced relationship with a first face of the ground plate 25; 6,7. In the example of FIGS. 2 and 3, the ground plate 6, 7 is formed of the outer ground plate 6 and the inner ground plate 7. The first face of the ground plate 6,7 comprises the face of the inner ground plate 7 which faces towards the patch radiator 19 and the face of the outer ground plate 6 which faces the radome 15, 16. The inner 7 and outer ground 6 plates, being connected together electrically, act as a single ground plate 6, 7.

In an embodiment of the invention, to provide reduced radiation in at least one direction in the hemisphere on the opposite side of the ground plate to the first face, that is to say to provide an improved from to back ratio for the antenna, there is provided a first and second conductive plate 10*a*, 10*b*, each being electrically isolated from the ground plate 25; 6,7 and each being disposed in an upstanding relationship to the first face of the ground plate, as can be seen from FIGS. 1, 2 and 3. The first and second conductive plates may each supported by a non-conductive support member 11*a*, 11*b* attached to the ground plate 25; 6,7. This allows the conductive plates to be held in place while maintaining electrical isolation. The non-conductive plastic support members may be made of plastic, and may conveniently be of hollow triangular cross-section as shown in FIGS. 1, 2 and 3, although other shapes are possible. Because the support members are not electrically conductive, they have little effect on the radiofrequency performance of the antenna, and so their shape is not critical. The first and second conductive plates 10*a*, 10*b* may be referred to as parasitic plates, or parasitic flanges, because they are isolated from the ground plate 25; 6,7 and so may receive and re-radiate radiation from the radiator elements. In embodiments of the invention, the reception and re-radiation of radiation by the first and second conductive plates 10*a*, 10*b*, that is to say the parasitic flanges, is arranged to cancel radiation that would tend to radiate from the back of the antenna, away from the main beam, thereby improving the front-to-back ratio of the antenna.

As shown in FIGS. 1, 2 and 3, the first and second conductive plates 10*a*, 10*b*, that is to say the parasitic flanges, may be made from a flat sheet, for example of aluminium, that extends along the length of the array of radiator elements. That is to say the conductive plates 10*a*, 10*b* are elongate, having a long side parallel to the ground plate 25; 6,7. In embodiments of the invention, the conductive plates 10*a*, 10*b* may have a width, shown as dimension "a" in FIG. 1, between 0.2 and 0.4 wavelengths at an operating frequency of the antenna array assembly. This may provide a good front-to-back ratio. A width of substantially a quarter of a wavelength may be particularly beneficial. In embodiments of the invention, the width of the conductive plates may be between 0.2 and 0.4 wavelengths at a centre frequency of the operating frequency range of the antenna. This may be, for example, 5.5 GHz.

As can be seen from FIGS. 1, 2 and 3, the array of radiator elements 19; 19*a*, 19*b* may be between first and second substantially parallel conductive walls 12*a*, 12*b* projecting from the first face of the ground plate 25; 6,7. The first and second conductive plate 10*a*, 10*b*, which are not grounded and act as parasitic flanges, may be in a substantially parallel relationship with the first and second conductive walls 12*a*, 12*b*, which are grounded, being connected to the ground plate 25; 6,7. The first and second conductive plates 10*a*, 10*b* may be outside the first and second conductive walls 12*a*, 12*b* with respect to the array of radiator elements 19.

As shown by FIG. 1, the first and second conductive plate 10*a*, 10*b*, and the first and second conductive walls 12*a*, 12*b* are typically substantially planar, and are typically substantially perpendicular to at least part of the top face of the ground plate 25, which is typically substantially planar.

In an embodiment of the invention, the first and second conductive plates are each located with a distance, shown as dimension d in FIG. 1, between 0.1 and 0.4 wavelengths from the respective conductive wall at an operating frequency of the antenna array assembly. Locating each of the first and second conductive plates substantially a quarter of a wavelength from the respective conductive wall of the first and second conductive walls may be particularly beneficial in improving the front-to-back ratio of the antenna. In an embodiment of the invention, the first and second conductive plates may each be located between 0.1 and 0.4 wavelengths from the respective conductive wall at a centre frequency of an operating frequency of the antenna array assembly.

As may be seen from FIGS. 1, 2 and 3, the first and second conductive plates 10*a*, 10*b* may be held by the non-conductive supports 11*a*, 11*b* some distance away from the ground plate 25; 6,7. In an embodiment of the invention, the first and second conductive plates 10*a*, 10*b* may be disposed at least 0.1 wavelengths away from the ground plate at an operating frequency of the antenna array assembly. This may improve the contribution of the conductive plates to front-to-back isolation.

The first and second conductive walls 12*a*, 12*b* may project from the ground plate by at least a quarter of a wavelength at an operating frequency of the antenna array assembly, which may allow the conductive walls to contribute to front-to-back isolation, in addition to improving azimuth beamwidth.

As may be seen in FIGS. 2 and 3, there may also be further grounded walls 13*a-f* projecting from the ground plate, to further improve the front-to-back ratio of the antenna. In an embodiment of the invention, the antenna array assembly comprises third and fourth conductive walls 13*a*, 13*d* projecting from the first face, in a substantially parallel relationship with the first and second conductive walls 12*a*, 12*b*, and further from the array of radiator elements 19 than are the first and second conductive plates 10*a*, 10*b*, and may comprise further conductive walls 13*b*, 13*c*, 13*e*, 13*f*, also in a substantially parallel relationship with the first and second conductive walls 12*a*, 12*b*, and further from the array of radiator elements than are the third and fourth conductive walls 13*a*, 13*d*.

In an embodiment of the invention, each conductive wall 12*a*, 12*b*, 13*a-f* may have a first substantially vertical section extending from the ground plate and a second section connected to the first section which is inclined towards the array of radiator elements. This may further improve front-to-back isolation.

In an embodiment of the invention, the ground plate and the conductive walls comprise a non-conductive material having a conductive coating. This allows the ground plate to be light weight and to be moulded in a shape to include the conductive walls, which may be an economical manufacturing method. The non-conductive moulding may comprises a plastic material and the conductive surface may comprise copper.

The example of a linear array, as shown in FIGS. 1, 2 and 3, may be particularly suited for the provision of improved front-to-back isolation by the provision of the conductive plates 10*a*, 10*b* and/or the grounded conductive walls 12*a*, 12*b*, 13*a-f*, with the long axis of the first and second conductive plates 10*a*, 10*b* being arranged parallel to the longitudinal axis of the linear array.

In an embodiment of the invention, the positions of the first and second conductive plates 10*a*, 10*b* may be transposed with the positions of the first and second conductive walls 12*a*, 12*b*. Alternatively, the first and second conductive walls 12*a*, 12*b* may be replaced by a further pair of conductive plates, isolated from the ground plate.

The front-to-back isolation may, for example, be specified as the grain difference between the forward gain measured in the main beam of a sector antenna, covering for example, a +/− 45 degree sector in azimuth, and the maximum gain measured 180 degrees away from an angle in the covered sector. This may be measured at a range of elevation angles, for example from +2 degrees to −28 degrees. In an embodiment of the invention, a front-to-back isolation in excess of 34 dB for each elevation may, as an example, be achieved for each azimuth angle within the sector.

The improvement in front-to-back isolation compared with an antenna assembly that does not have the isolated conductive plates is thought to be achieved by re-radiated signals from the isolated conductive plates 10*a*, 10*b* cancelling signals from the radiator elements which are propagating towards the edges of the ground plate.

For example, it has been found that in an embodiment of the invention as illustrated by FIGS. 2 and 3, an average improvement of front-to-back isolation of 3 dB or more may be achieved for horizontally polarised radiation as compared to an antenna assembly without the isolated conductive plates 10*a*, 10*b*. Horizontal polarisation, in this example, corresponds to signals having a horizontal electric field vector, for cases where the long axis of the array is vertical.

As shown in FIGS. 2 and 3, the radome may have two non-conductive layers 14, 15, spaced apart by substantially a quarter of a wavelength at an operating frequency of the antenna assembly, at least in a part of the radome through which the beam from the antenna array may pass. Each layer is typically less than 5% of a wavelength thick. The cavity 16 between the layers may be filled with air. Spacing members 17*a*, 17*b* between the layers may be configured to be outside the region of the radome through which the main beam may pass. The material of which the radome is composed may have a relative dielectric constant of 3.2 in one embodiment. This arrangement has been found to enable transmission of the beam through the radome with low loss, and the radome has only a small effect on the radiation pattern, isolation and gain of the antenna. The spacing of the layers by substantially a quarter of a wavelength has the beneficial effect that reflections from each surface cancel each other.

The radiator elements may be patch radiator elements configured to radiate and/or receive with at least a first polarisation normal to a long axis of the first and second conductive plates. In this case, the improved front-to-back isolation may be provided in particular for the first polarisation.

Figure 4A:
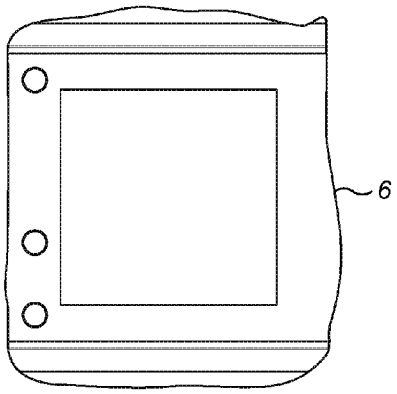
FIG. 4A is a plan view of an outer ground plate in an embodiment of the invention.
Figure 4B:
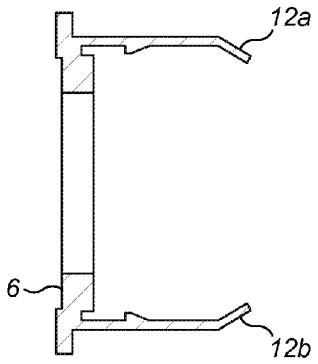
FIG. 4B is a cross-sectional view of an outer ground plate in an embodiment of the invention.
Figure 4C:
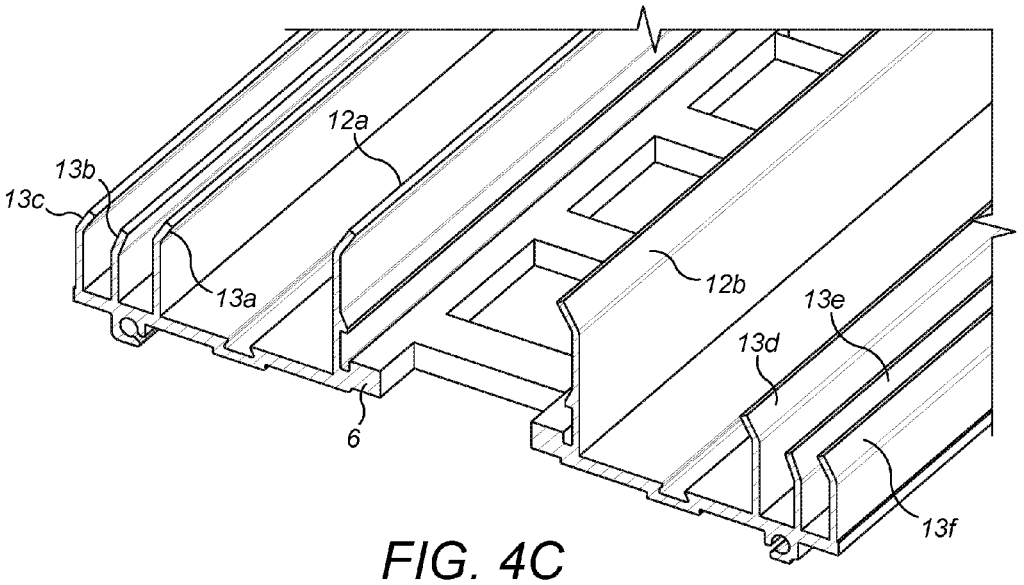
FIG. 4C is an oblique view of an outer ground plate for an array of antenna elements in an embodiment of the invention.

FIGS. 4A, 4B, and 4C show details of the outer ground plate 6 in an embodiment of the invention.

Figure 5:
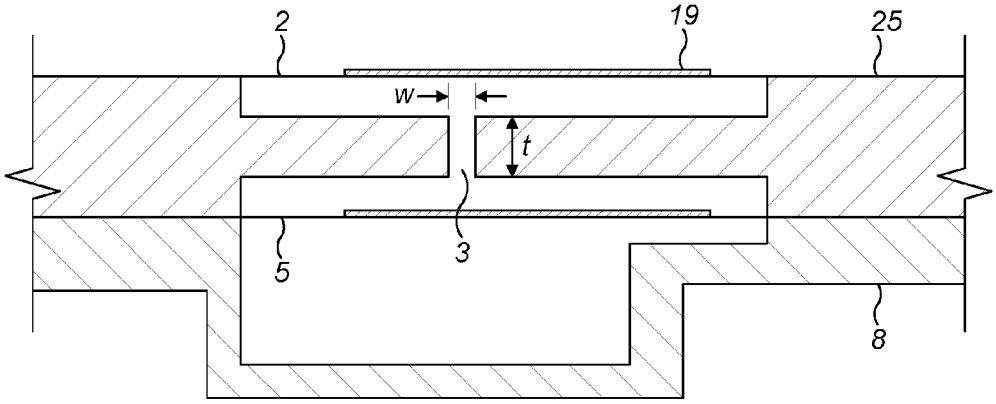
FIG. 5 is a schematic diagram showing a cross-section through an aperture coupled patch antenna element in an embodiment of the invention.

FIG. 5 is a schematic diagram showing an aperture coupled patch antenna element in an embodiment of the invention, which may form a part of an antenna array assembly. The aperture coupled patch antenna element comprises a radiator element, which is in this example a patch radiator 19, which may be a conductive patch carried on a non-conductive film 2, a ground plate 25 having a aperture 3 passing between first and second opposite sides, and a feed line formed as a transmission line 21 which may be carried on a thin non-conductive film 5. A conductive cover plate 8 may be provided on the opposite side of the transmission line 21, electrically connected to the ground plate 25, to prevent radiation from the transmission line. Signals are coupled from the transmission line 21 through the aperture 3 to the patch radiator 19, for transmission. By reciprocity, signals received by the patch radiator 19 are also coupled to the feed line through the aperture 3 on reception.

Figure 6A:
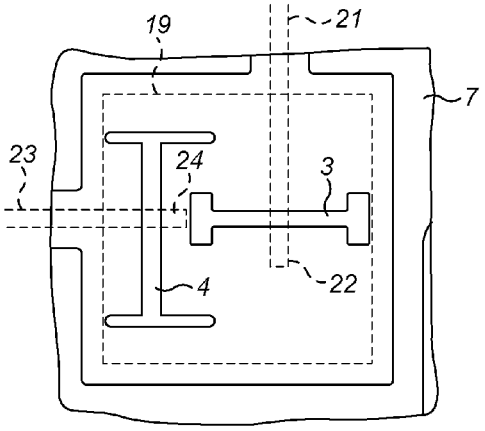
FIG. 6A shows a plan view of a dual polarised aperture coupled patch antenna element in an embodiment of the invention.

FIG. 6A shows an aperture coupled patch antenna in plan view in an embodiment of the invention. The ground plate 7 corresponds to the ground plate 25 of FIG. 5. It can be seen that the aperture 3 comprises a centre section that may be referred to as a slot, and in this embodiment has a termination cavity at each end of the slot, so that the aperture is I-shaped, having a cross-piece across each end of the slot. This provides good coupling while limiting the overall length of the aperture. It can be seen that the slot part of the aperture has an elongate cross-section in the plane of the first side of the ground plate, the cross-section having substantially parallel sides extending along the length of the cross-section. The width w of the slot is the distance between the parallel sides of the cross-section of the slot.

Conventionally, a slot may be provided in a thin ground plane. By contrast, in embodiments of the invention, as shown in FIG. 5, the thickness t of the ground plate 25 at the slot is greater than the width of the slot w. This allows signals to be coupled from the first transmission line 21 on one side of a ground plate 25 to the patch radiator 19 on the other side, and vice versa, with a low loss to radio frequency signals, while allowing the use of a ground plate with appreciable thickness, greater than the slot width. This provides the ground plate with mechanical strength, and allows the ground plate to be manufactured with by a technique, for example casting, that is economical but not suited to producing thin sheets as would be required with a conventional ground plane. The ground plate may be part of a larger assembly, such an antenna array, and may provide structural strength to the assembly. This also provides economies and eliminates design restraints caused by the provision of a printed circuit board or a conductive ground sheet requiring support. It is not obvious that an aperture through such a thick ground plate could be used to couple signals from one side to the other with low loss.

In an embodiment of the invention, the width of the slot is between 1 and 2 mm and the thickness of the ground plate is greater than 2 mm. These dimensions provide a ground plate that is particularly robust and cheap to manufacture while providing low radio frequency loss. In fact, it has been found that the slot may operate with loss even when the thickness of the ground plate is 4 times or more greater than the width of the slot.

It can be seen from FIG. 6A that the first transmission line 21 may have an end terminated with a first termination stub 22. This provides low return loss as seen by the feed network. A termination stub may be formed as various well known shapes, for example a length of track a quarter wavelength in length beyond the point where the transmission line crosses the slot.

It can also be seen from FIG. 6A that the patch radiator 19 may be substantially square, having sides approximately half a wavelength in length or less at an operating frequency of the antenna, as is well known in the art.

As shown in FIG. 6A, the aperture coupled patch antenna may comprise a second feed track comprising a second transmission line 23, which may be terminated in a second termination stub 24. Signals may be coupled from the second transmission line 23 to the patch radiator 19 through a second aperture 4, having a slot arranged at right angles to the slot of the first aperture 3, so as to couple signals to the patch radiator for radiation at an orthogonal polarisation to those coupled through the first slot. In this way, a dual polarised aperture coupled patch antenna may be formed.

Figure 6B:
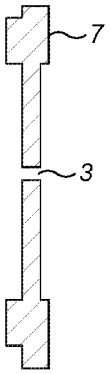
FIG. 6B shows cross-sectional view of a ground plate of a dual polarised aperture coupled patch antenna element in an embodiment of the invention.
Figure 6C:
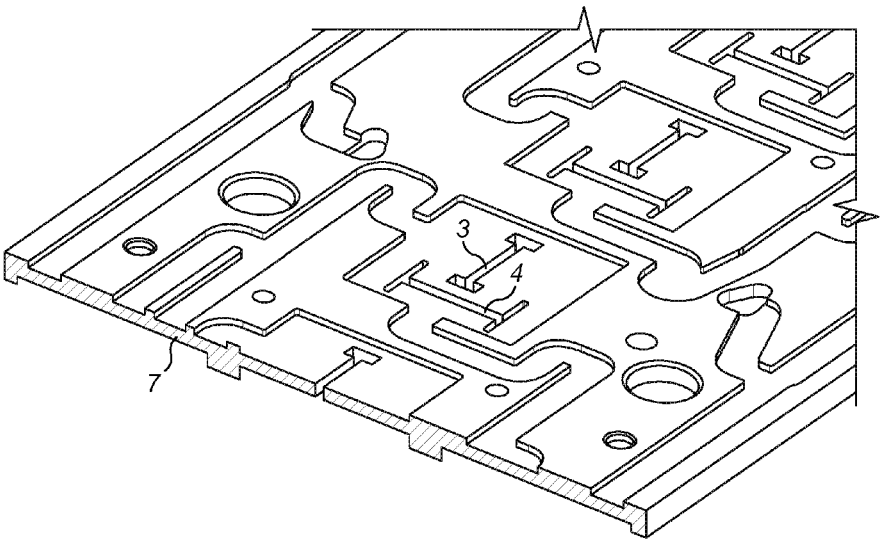
FIG. 6C shows an oblique view of a plate of an array of dual polarised aperture coupled patch antenna elements in an embodiment of the invention.

FIGS. 6B and 6C show the ground plate 7 in an embodiment of the invention in more detail. The ground plate 7 may also be referred to as the inner ground plate.

Figure 7A:
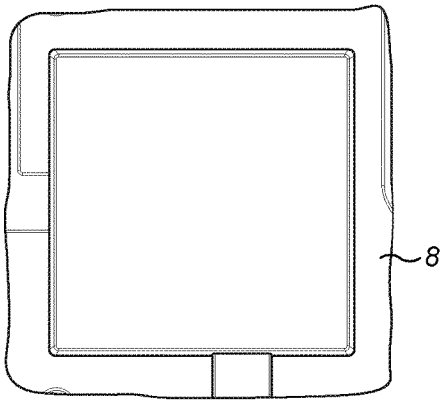
FIG. 7A is a plan view of cover plate of an aperture coupled patch antenna element in an embodiment of the invention.
Figure 7B:
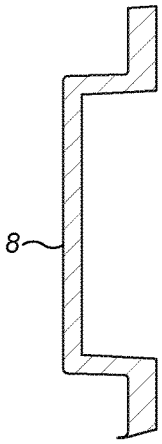
FIG. 7B is a cross-sectional view of cover plate of an aperture coupled patch antenna element in an embodiment of the invention.
Figure 7C:
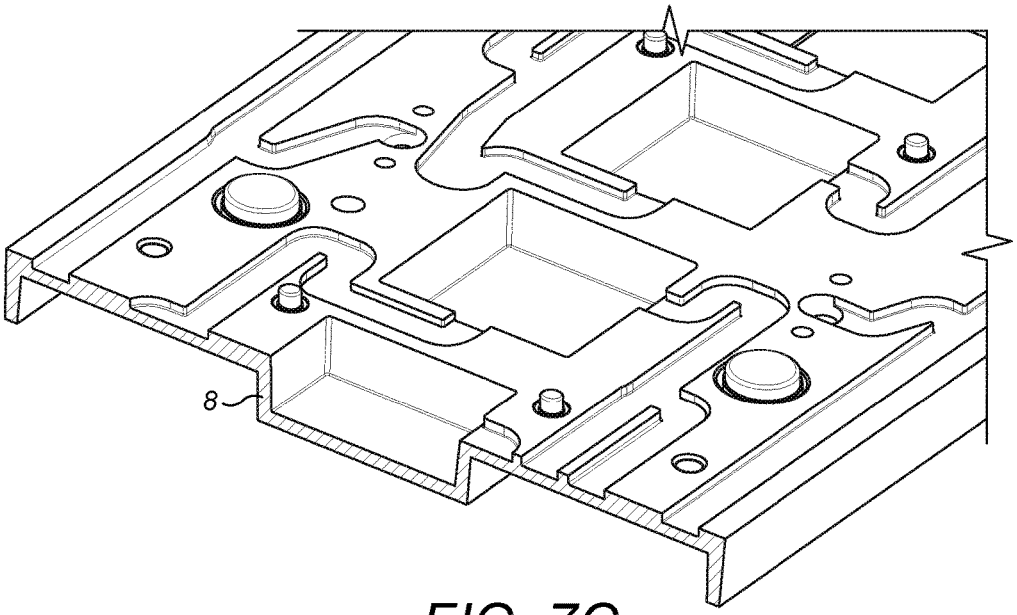
FIG. 7C is an oblique view of cover plate of an array of dual polarised aperture coupled patch antenna elements in an embodiment of the disclosure.

FIGS. 7A, 7B and 7C show the cover plate 8 in more detail. It can be seen from FIGS. 2, 3, 5 and FIGS. 7B and 7C that the section of the cover plate 8 underlying the apertures 3, 4 in the ground plate 25; 7 for coupling to a patch radiator 19 has a greater spacing from the feed tracks carried by film 5 than the spacing between the feed tracks carried by the film 5 and the ground plate 25; 7, typically more than 4 times the spacing. This contributes to the provision of a low loss radio frequency coupling through the apertures. A section of the cover plate 8 that does not underlie the apertures 3, 4 in the ground plate for coupling to a patch radiator 19 has a substantially similar spacing from the feed tracks carried by film 5 to the spacing between the feed tracks carried by the film 5 and the ground plate. This provides a structure that provides controlled track impedance, which is relatively tolerant of displacement of the tracks due to distortion of the non-conductive film carrying the tracks.

In an embodiment of the invention the slot has a length of less than half a wavelength at an operating frequency of the radio frequency transmission arrangement, giving a compact implementation of the radio frequency transmission arrangement with low loss.

In an embodiment of the invention the first transmission line is formed by a metallic track on a polyester film, disposed with an air gap between the polyester film and the ground plate. This provides reduced loss in the feed network. In an embodiment of the invention the patch radiator is formed by a metallic patch on a polyester film, disposed with an air gap between the polyester film and the ground plate. This provides a low loss patch radiator.

In an embodiment of the invention the aperture is an air-filled cavity. This allows a particularly low-loss connection to be established. In an embodiment of the invention, the ground plate is composed of metal, which may be cast aluminium. This provides a ground plate with good strength. The apertures may be economically produced by moulding. Alternatively, the ground plate may be composed of a non-conductive moulding having an electrically conductive coating. This allows the ground plate to be light weight and to be moulded in a shape to include the aperture, which may be an economical manufacturing method. The non-conductive moulding may comprise a plastic material and the conductive surface may comprise copper.

Aperture coupled patch antennas according to embodiments of the invention, for example as incorporated into an antenna array assembly as illustrated in FIGS. 2 and 3, may provide good coverage of a cellular sector. For example, an antenna intended to cover a 90 degree sector may maintain a gain relative to the peak of the main beam of −10 dB or higher over a 90 degree range in azimuth over a frequency range of 4.9 GHz to 6.1 GHz.

From the foregoing description, it can be seen that a patch antenna is a type of radio antenna with a low profile, which can be mounted on a flat surface. It may consist of a flat rectangular sheet or "patch" of metal, mounted over a larger sheet of metal called a ground plane. The assembly may be contained inside a plastic radome, which protects the antenna structure from damage. The metal sheet above the ground plane may be viewed as forming a resonant piece of microstrip transmission line with a length of approximately one-half wavelength of the radio waves. The radiation mechanism may be viewed as arising from discontinuities at each truncated edge of the microstrip transmission line. The radiation at the edges may cause the antenna to act slightly larger electrically than its physical dimensions, so in order for the antenna to be resonant, a length of microstrip transmission line slightly shorter than one-half a wavelength at the frequency may be used to form the patch.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. An antenna array assembly, comprising:

a ground plate;

an array of radiator elements disposed in a spaced relationship with a first face of the ground plate, the array being between first and second substantially parallel conductive walls projecting from the first face of the ground plate, the first and second substantially parallel conductive walls being grounded to the ground plate;

a first and second conductive plate, each being electrically isolated from the ground plate, and each being disposed in an upstanding relationship to the first face of the ground plate in a substantially parallel relationship with the first and second conductive walls, the first and second conductive plates being disposed outside the first and second conductive walls with respect to the array of radiator elements, and each being supported by a non-conductive support member attached to the ground plate, and the first and second conductive plates being elongate, having a long side parallel to the ground plate; and third and fourth conductive walls projecting from the first face of the ground plate and being grounded to the ground plate, in a substantially parallel relationship with the first and second conductive walls, and further from the array of radiator elements than are the first and second conductive plates.

2. An antenna array assembly according to claim 1, wherein the first and second conductive plates have a width between 0.2 and 0.4 wavelengths at an operating frequency of the antenna array assembly.

3. An antenna array assembly according to claim 2, wherein the first and second conductive plates have a width of substantially a quarter of a wavelength at an operating frequency of the antenna array assembly.

4. An antenna array assembly according to claim 1, wherein the first and second conductive plates are each located between 0.1 and 0.4 wavelengths from the respective conductive wall at an operating frequency of the antenna array assembly.

5. An antenna array assembly according to claim 4, wherein the first and second conductive plates are each located substantially a quarter of a wavelength from the respective conductive wall of the first and second conductive walls at an operating frequency of the antenna array assembly.

6. An antenna array assembly according to claim 1, wherein the first and second conductive plates are each supported by a non-conductive support member attached to the ground plate.

7. An antenna assembly according to claim 1, wherein the first and second conductive plates are disposed at least 0.1 wavelengths away from the ground plate at an operating frequency of the antenna array assembly.

8. An antenna array according to claim 1, wherein the first and second conductive walls project from the ground plate by at least a quarter of a wavelength at an operating frequency of the antenna array assembly.

9. An antenna array assembly according to claim 1, comprising a plurality of further conductive walls, further to the first, second, third and fourth conductive walls, projecting from the first face, in a substantially parallel relationship with the first and second conductive walls, and further from the array of radiator elements than are the third and fourth conductive walls.

10. An antenna array assembly according to claim 1, wherein each conductive wall has a first substantially vertical section extending from the ground plate and a second section connected to the first section which is inclined towards the array of radiator elements.

11. An antenna array assembly according to claim 1, wherein the radiator elements are patch radiator elements configured to radiate and/or receive with at least a first polarisation normal to a long axis of the first and second conductive plates.

12. An antenna array assembly according to claim 1, wherein the radiator elements are configured as a linear array having a longitudinal axis parallel to a long axis of the first and second conductive plates.

13. An antenna array assembly according to claim 1, wherein the ground plate and the conductive walls comprise a non-conductive material having a conductive coating.

14. A method of providing increased front-to-back isolation in an antenna array assembly having a ground plate and an array of radiator elements disposed in a spaced relationship with a first face of the ground plate, comprising:

providing first and second substantially parallel conductive walls projecting from the first face of the ground plate and being grounded to the ground plate, the first being on one side of the array of radiator elements and the second being on the opposite side;

providing a first and second conductive plate, each being electrically isolated from the ground plate, and each being disposed in an upstanding relationship to the first face of the ground plate in a substantially parallel relationship with the first and second conductive walls, the first and second conductive plates being disposed outside the first and second conductive walls with respect to the array of radiator elements, and each being supported by a non-conductive support member attached to the ground plate, and the first and second conductive plates being elongate, having a long side parallel to the ground plate; and providing third and fourth conductive walls projecting from the first face of the ground plate and being grounded to the ground plate, in a substantially parallel relationship with the first and second conductive walls, and further from the array of radiator elements than are the first and second conductive plates.

15. A method according to claim 14, wherein the first and second conductive plates have a width between 0.2 and 0.4 wavelengths at an operating frequency of the antenna array assembly.

16. A method according to claim 15, wherein the first and second conductive plates have a width of substantially a quarter of a wavelength at an operating frequency of the antenna array assembly.

17. A method according to claim 14, comprising disposing the first and second conductive plates between 0.1 and 0.4 wavelengths from the respective conductive wall at an operating frequency of the antenna array assembly.

18. A method according to claim 17, comprising disposing the first and second conductive plates substantially a quarter of a wavelength from the respective conductive wall of the first and second conductive walls at an operating frequency of the antenna array assembly.

* * * * *